United States Patent [19]

Prenger et al.

[11] Patent Number: 5,076,067

[45] Date of Patent: Dec. 31, 1991

[54] COMPRESSOR WITH LIQUID INJECTION

[75] Inventors: Werner H. Prenger, Coldwater; Stephen M. Seibel, Sidney, both of Ohio

[73] Assignee: Copeland Corporation, Sidney, Ohio

[21] Appl. No.: 561,019

[22] Filed: Jul. 31, 1990

[51] Int. Cl.[5] ..... F25B 41/00

[52] U.S. Cl. ..... 62/197; 62/126; 62/505; 417/32

[58] Field of Search ..... 62/197, 228.1, 228.3, 62/505, 126, 129; 417/292, 32; 361/22

[56] References Cited

U.S. PATENT DOCUMENTS

| | | | |
|---|---|---|---|
| 2,946,203 | 7/1960 | Carver | 62/505 X |
| 3,232,519 | 2/1966 | Long | 417/32 X |
| 3,276,221 | 10/1966 | Crumley | 62/505 X |
| 3,278,111 | 10/1966 | Parker | 417/32 |
| 3,285,030 | 11/1966 | Coyne | 62/197 |
| 3,396,550 | 8/1968 | Cawley | 62/117 |

*Primary Examiner*—Harry B. Tanner

*Attorney, Agent, or Firm*—Harness, Dickey & Pierce

[57] ABSTRACT

A refrigeration system incorporating a scroll type compressor is disclosed which includes an injection system for injecting liquid refrigerant into the suction inlet opening of the compressor in response to excessive discharge gas temperature. A temperature sensor assembly is located within a well formed in the discharge chamber and serves to control actuation of the liquid injection system. In one embodiment the sensor assembly incorporates a pair of thermostats, one to control liquid injection and one to shut down the compressor in the event of continued overheating. In another embodiment a single thermostat having two tip temperatures is utilized. In a third embodiment a temperature sensing transducer is utilized in combination with a microprocessor.

20 Claims, 5 Drawing Sheets

COMPRESSOR WITH LIQUID INJECTION

BACKGROUND AND SUMMARY OF THE INVENTION

The present invention relates generally to scroll compressors and more specifically to a liquid injection system for preventing overheating of the scroll compressor.

Scroll compressors are becoming increasingly popular due to their capability for extremely high operating efficiency as compared to prior reciprocating, rotary and screw compressors. However, one problem such scroll compressors have in common with these other types of compressors is the need to avoid excessive heating of the compressor during high load operation.

In order to overcome this problem, liquid injection systems have been previously developed for scroll compressors. In one such prior system a thermostat is placed on the outer shell in an area adjacent the discharge from the compression chambers. The thermostat serves to control the injection of liquid into the compression chambers at a point intermediate the suction inlet and discharg openings. The compressor also includes separate thermally responsive means to deenergize the compressor in response to excessive temperature.

While this arrangement does serve to help in preventing overheating of the compressor, the placement of the thermostat on the shell reduces the accuracy thereof in that the actual temperature sensed by the thermostat will vary depending upon ambient conditions. Thus, for example, cool ambient conditions may result in a sensed discharge temperature lower than the actual thus delaying the actuation of the injection system. Also high ambient conditions may result in premature actuation of the injection system or excessive amounts of liquid being injected.

The present invention, however, provides a unique fluid injection system including a control system therefor which is operative in direct response to excessive discharge temperature to inject condensed liquid into the compressor so as to thereby avoid overheating. In the event the injection of liquid into the compressor fails to reduce or prevent further increase in the discharge gas temperature, further means are provided responsive thereto to deenergize the compressor.

In one form, the liquid injection control system incorporates a pair of thermostats positioned within a common well or housing extending into this discharge chamber, one of which serves to control valve means for injecting liquid into the suction chamber while the other is responsive to further increases in discharge temperature to deenergize the compressor. In another embodiment, a single thermostat having two separate trip points is utilized to control both liquid injection and compressor deenergization. In a still further embodiment, a thermal transducer is utilized which operates to transmit a signal indicative of discharge temperature to a suitable microprocessor which microprocessor operates to control both liquid injection and compressor deenergization.

Thus, the liquid injection system of the present invention provides dual protection against possibly damaging overheating of the compressor. Further, because the discharge gas temperature is sensed at or immediately adjacent its entry into the discharge muffler, the present invention assures greater accuracy in the control of the amount of liquid being injected as well as more response time.

Additional advantages and features of the present invention will become apparent from the subsequent description and the appended claims taken in conjunction with the accompanying drawings.

DETAILED DESCRIPTION OF THE PREFERRED EMBODIMENTS

Figure 1:
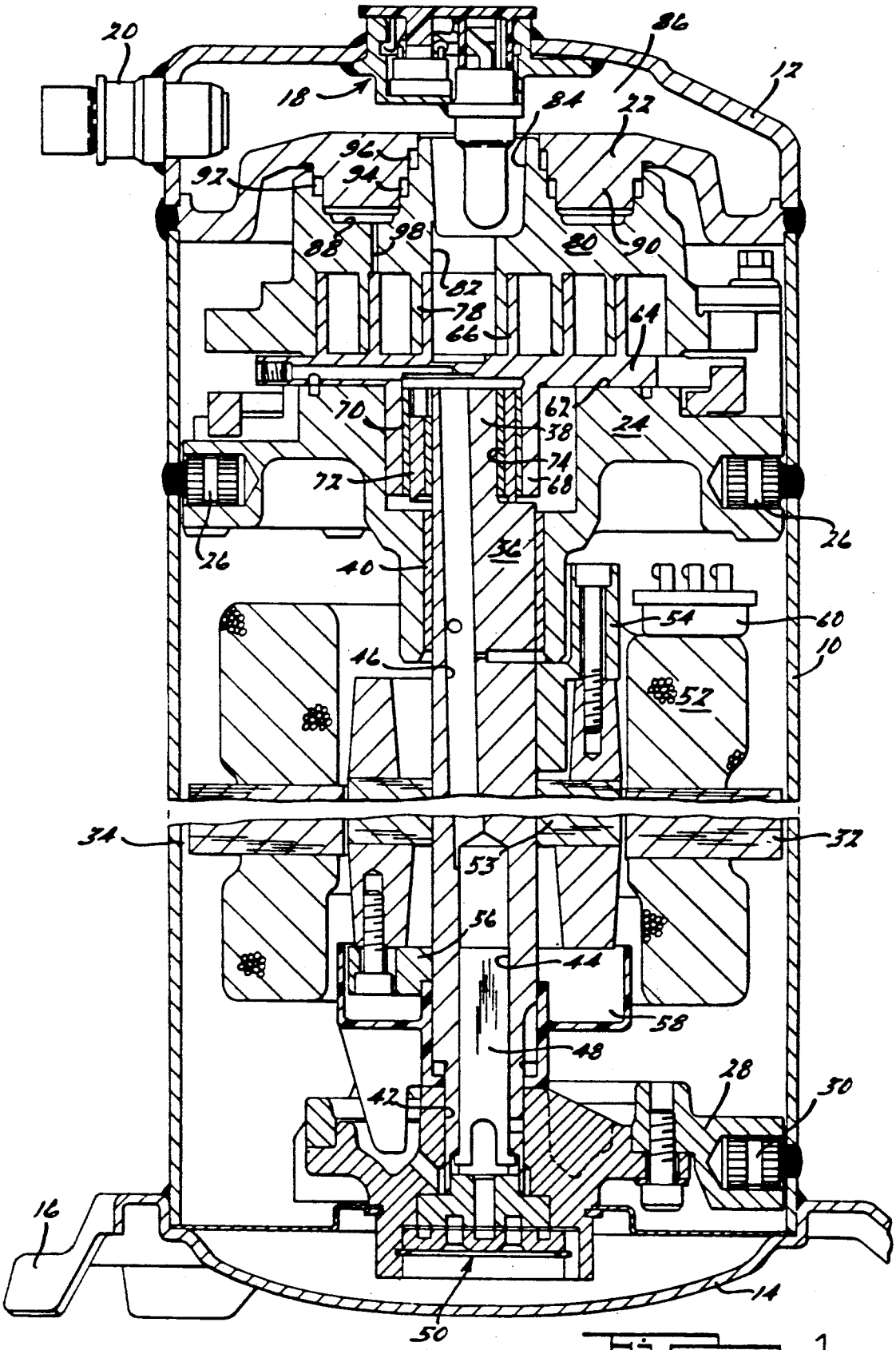
FIG. 1 is a section view of a scroll compressor in accordance with the present invention.

Referring now to the drawings, a scroll compressor is illustrated in vertical section in FIG. 1. The compressor comprises a generally cylindrical hermetic shell 10 having welded at the upper end thereof a cap 12 and at the lower end thereof a base 14 having a plurality of feet 16. Cap 12 is provided with a thermostat assembly indicated generally at 18 which has a portion extending into the interior of the shell, and a refrigerant discharge fitting 20 which may have the usual discharge valve therein (not shown). Other major elements affixed to the shell include a transversely extending partition 22 which is welded about its periphery at the same point that cap 12 is welded to shell 10, a main bearing housing 24 which is pin welded to shell 10 at a plurality of points utilizing pins 26, and a lower bearing housing 28 also having a plurality of radially outwardly extending legs each of which is pin welded to shell 10 utilizing a pin 30. A motor stator 32 which is generally square in cross section but with the corners rounded off is press fit into shell 10.

The flats between the rounded corners on the stator provide passageways between the stator and shell, indicated at 34 which facilitate the flow of lubricant from the top of the shell to the bottom. A crankshaft 36 having an eccentric crank pin 38 at the upper end thereof is rotatably journaled in a bearing 40 in main bearing housing 24 and a second bearing 42 in lower bearing housing 28. Crankshaft 36 has at the lower end a relatively large diameter concentric bore 44 which communicates with a radially outwardly inclined smaller diameter bore 46 extending upwardly therefrom to the top of the crankshaft. Disposed within bore 44 is a stirrer 48 and keyed to the bottom of the crankshaft is a lubricating oil pump indicated generally at 50. The lower portion of the interior shell 10 is filled with lubricating oil and pump 50 is the primary pump acting in conjuction with bore 44 which acts as a secondary pump to pump lubricating fluid up the crankshaft and into passageway 46 and ultimately to all of the various portions of the compressor which require lubrication.

Crankshaft 36 is rotatively driven by an electric motor including stator 32, windings 52 passing therethrough and a rotor 53 press fit on the crankshaft and having upper and lower counterweights 54 and 56 respectively. A counterweight shield 58 may be provided to reduce the work loss caused by counterweight 56 spinning in the oil in the sump. The usual motor protector 60 may be affixed to the windings in order to provide conventional overheating protection.

The upper surface of main bearing housing 24 is provided with a flat thrust bearing surface 62 on which is disposed an orbiting scroll 64 having the usual spiral vane or wrap 66 on the upper surface thereof. Projecting downwardly from the lower surface of orbiting scroll 64 is a cylindrical hub having a journal bearing 70 therein and in which is rotatively disposed a drive bushing 72 having an inner bore 74 in which crank pin 38 is drivingly disposed. Crank pin 38 has a flat on one surface which drivingly engages a flat surface formed in a portion of bore 74 (not shown) to provide a radially compliant driving arrangement, such as shown in assignee's U.S. Pat. No. 4,877,382, the disclosure of which is hereby incorporated by reference. Wrap 66 meshes with a non-orbiting spiral wrap 78 forming a part of non-orbiting scroll 80 which is mounted to main bearing housing 24 in any desired manner which will provide limited axial movement of scroll member 80 (the manner of such mounting not being relevant to the present invention). Non-orbiting scroll member 80 has a centrally disposed discharge passageway 82 communicating with an upwardly open recess 84 which is in fluid communication with the discharge muffler chamber 86 defined by cap 12 and partition 22. Non-orbiting scroll member 80 has in the upper surface thereof an annular recess 88 in which is sealingly disposed for relative axial movement an annular piston 90 integrally formed on partition 22. Annular elastomer seals 92, 94 and 96 serve to isolate the bottom of recess 88 from the presence of gas under discharge pressure so that it could be placed in fluid communication with a source of intermediate fluid pressure by means of a passageway 98. The non-orbiting scroll member is thus axially biased against the orbiting scroll member by the forces created by discharge pressure acting on the central portion of the scroll member and those created by intermediate fluid pressure acting on the bottom of recess 88. This axial pressure biasing is disclosed in much greater detail in assignee's above referenced U.S. Letters Patent.

The details of construction which incorporate the principals of the present invention are those which deal with the thermostat assembly and associated control system for injecting liquid refrigerant into the compressor in response to excessive compressor discharge temperature.

Figure 2:
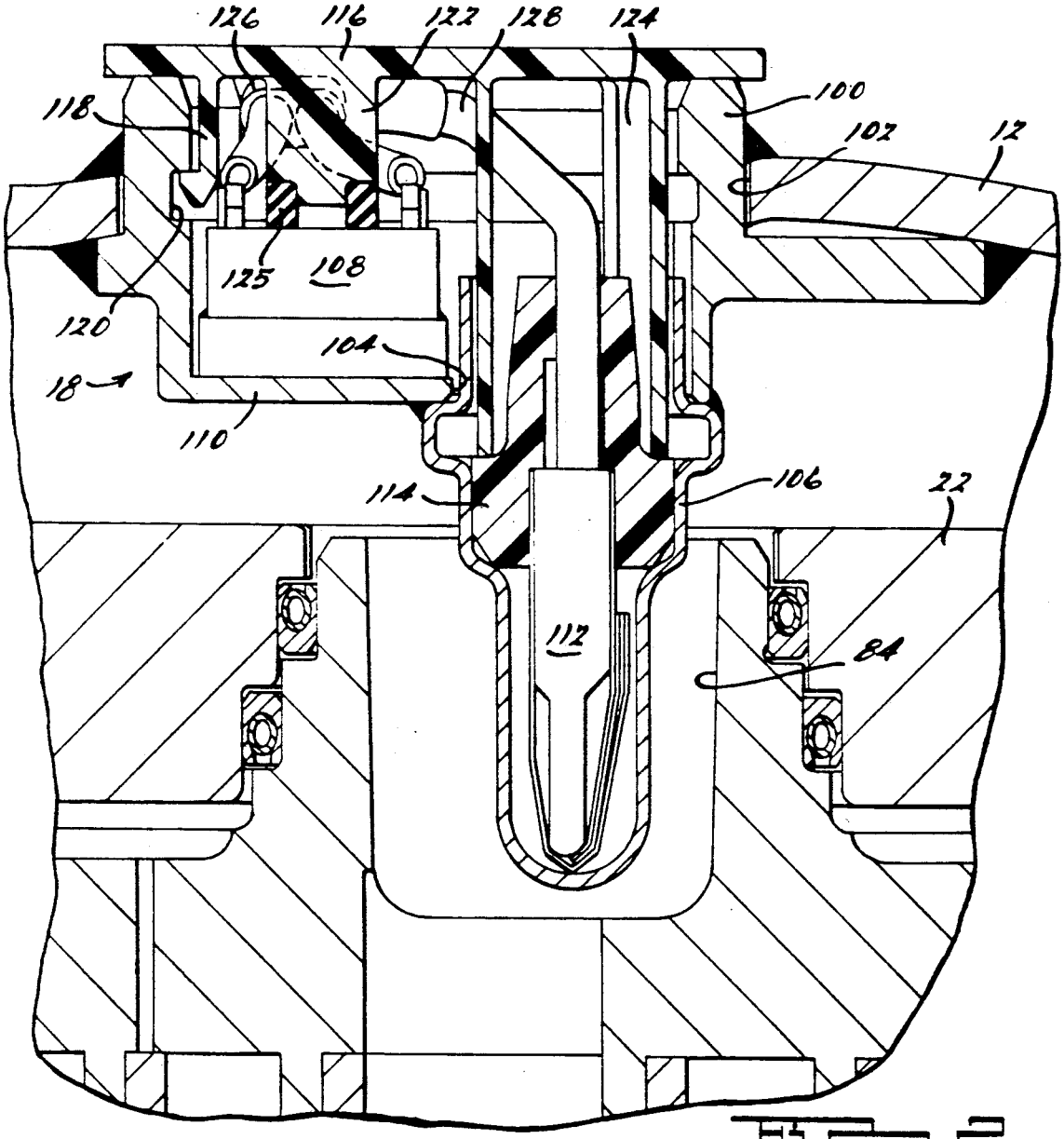
FIG. 2 is an enlarged fragmentary section view of the upper portion of the compressor of FIG. 1, showing the discharge muffler and associated thermostats.
Figure 3:
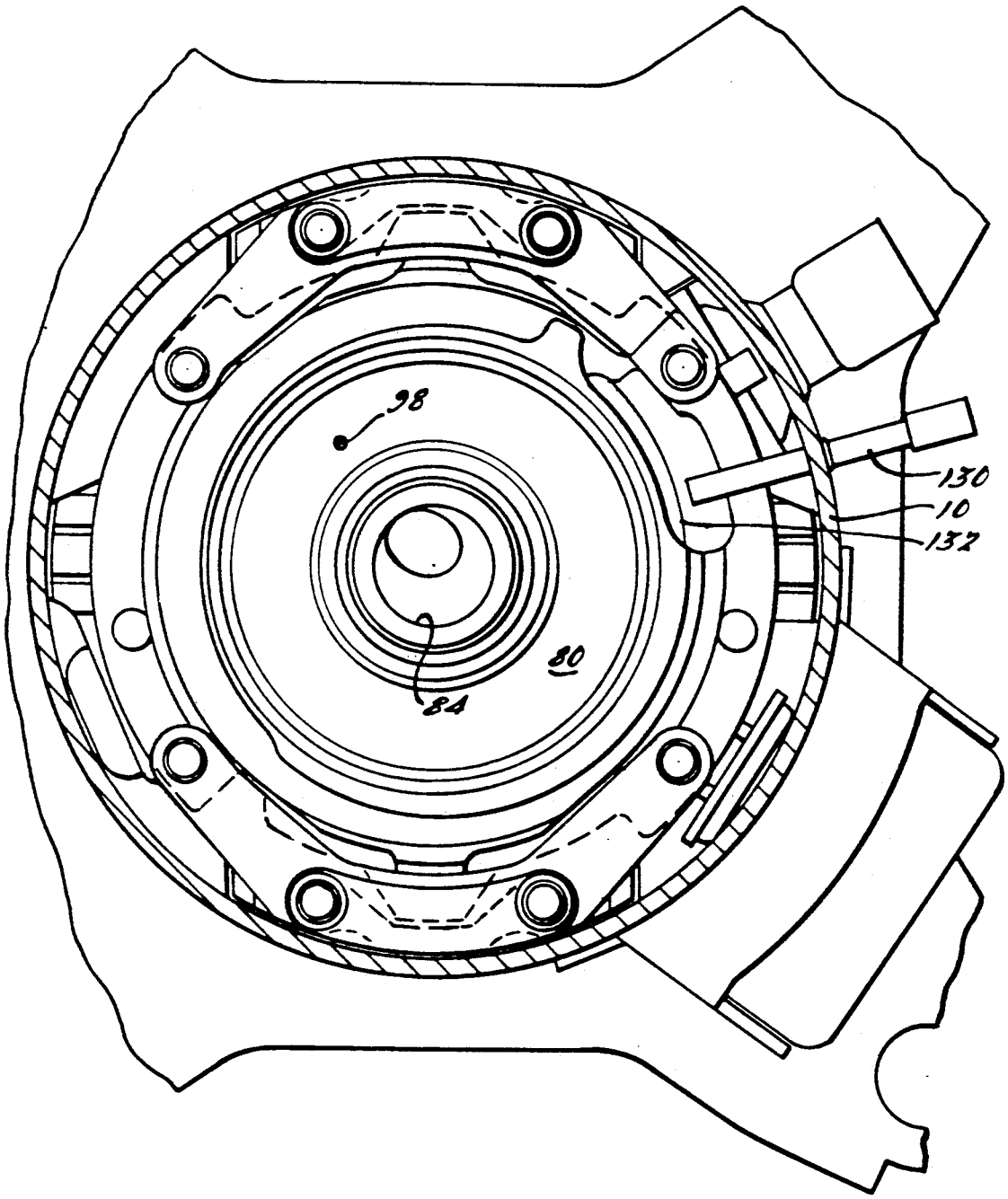
FIG. 3 is a plan view shown partially in section illustrating the relative positioning of the liquid injection port relative to the suction inlet.

Referring now to FIGS. 2 and 3, thermostat assembly 18 comprises a housing 100 sealingly secured within an opening 102 provided in cap 12 such as by welding. Preferably, housing 100 will be positioned in a generally overlying aligned relationship position with respect to discharge passageway 82 and recess 84 whereby discharge gas entering muffler chamber 86 will directly impinge thereon. Housing 100 is open at the top and has an opening 104 in the lower portion thereof through which a sheet metal sleeve 106 projects into recess 84 provided in non-orbitin scroll 80. Preferably, sleeve 106 will be welded to housing 100 so as to assure a fluid-tight interconnection therebetween. A first thermostat 108 is positioned within housing 100 with a lower portion thereof in direct heat transfer relationship with a bottom flange portion 110 thereof. A second thermostat 112 is positioned within sleeve 106 with a plastic sleeve member 114 serving to retain it in position therein.

A removable cover member 116 is also provided and includes suitable depending hooked leg members 118 which are designed to snap into an annular recess 120 in housing 100 to retain cover member in assembled relationship with housing 100. Cover member 116 also includes first and second depending projections 122, 124 which bear against an upper surface of thermostat 108 and sleeve member 114 of thermostat 112 respectively to further aid in retaining the thermostats in position within housing 100. An elastomeric grommet 125 is disposed between projection 122 and thermostat 108 to resiliently hold the latter in place. Two pairs of electric leads 126, 128 extend outwardly from respective thermostats 108, 112 and between cover 116 and housing 100 to remotely located control means (not shown).

As shown in FIG. 3, the liquid injection system of the present invention includes a fitting 130 extending through the sidewall of shell 10 with the inner end thereof positioned in aligned spaced relationship to a suction inlet opening 132 provided in non-orbiting scroll member 80.

Figure 4:
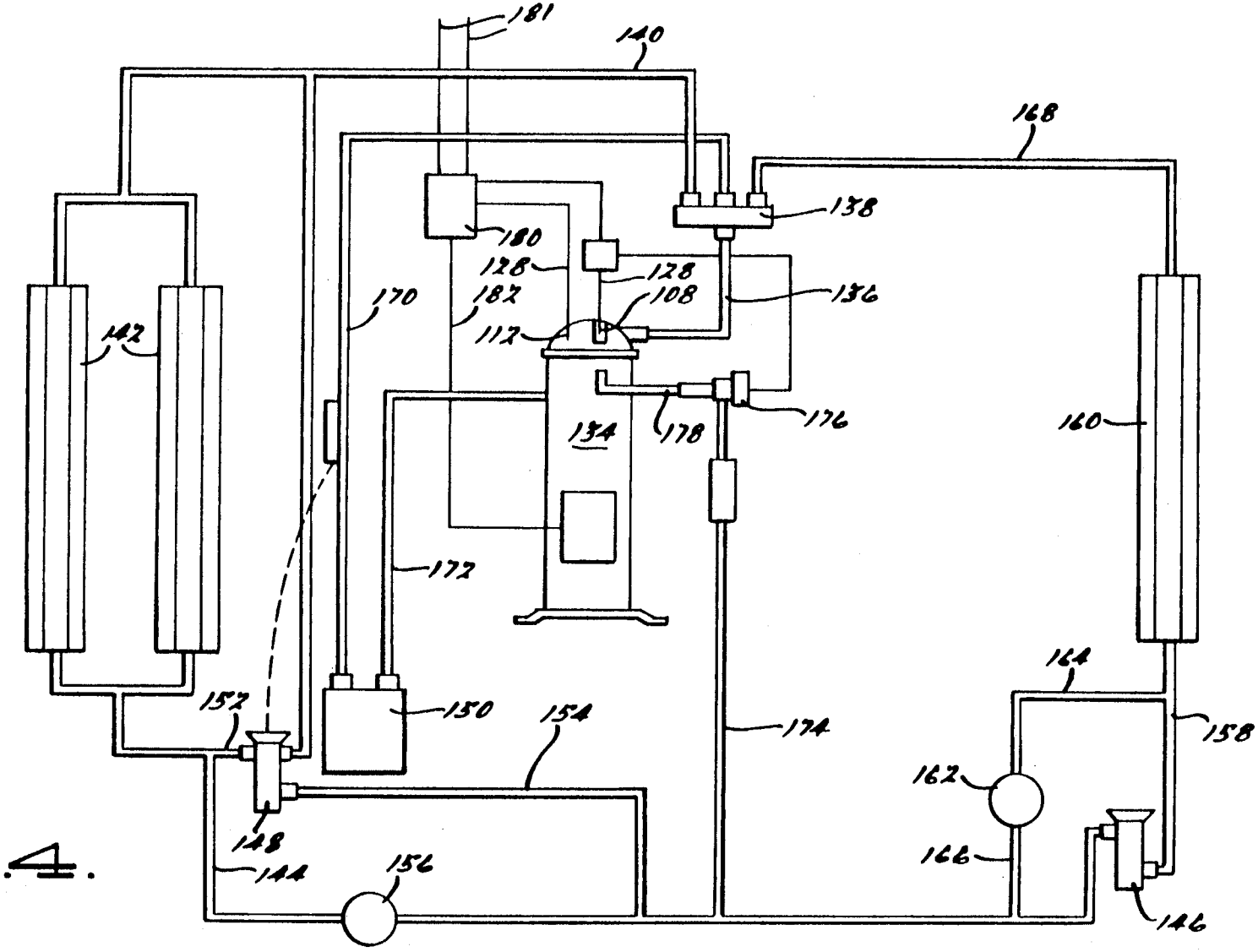
FIG. 4 is a schematic of a refrigeration system incorporating the liquid injection system of the present invention.

The operation of the liquid injection system of the present invention may be best understood with reference to the refrigeration system schematic diagram shown in FIG. 4. As shown therein, a compressor 134, preferably of the type shown and described above with reference to FIGS. 1–3 incorporating thermostat assembly 18, is provided. The refrigeration system illustrated is designed for use as both an air conditioning system and heat pump system. Compressor 134 includes a discharge line 136 for supplying compressed refrigerant to a reversing valve 138. A fluid conduit 140 extends from one port of reversing valve 138 to a pair of outdoor heat exchanging coils 142. From coils 142 a fluid conduit 144 extends to an expansion valve 146. A second expansion valve 148 is connected in parallel via conduits 152, 154 with a portion of conduit 144 within which a one-way check valve 156 is provided. A conduit 158 extends from expansion valve 146 to an indoor heat exchanger coil 160. A check valve 162 is also connected in parallel with expansion valve 146 via conduits 164, 166. The other end of coil 160 is connected to reversing valve 138 via conduit 168. Conduit 170 connects an inlet portion of reversing valve 138 to an inlet of suction accumulator 150, the outlet of which is connected to compressor 134 via conduit 172. As thus far described, the refrigeration circuit illustrated is designed to operate either in an air conditioning mode wherein coils 142 will act as a condenser and coil 160 as an evaporator with expansion valve 146 operational and expansion 148 bypassed via one-way check valve 156 or as a heat pump wherein the functions of coils 142 and 160 will be reversed, expansion valve 146 will be bypassed via one-way check valve 162, and expansion valve 148 will be operational.

In order to provide a supply of liquid refrigerant for injection into compressor 134, a conduit 174 extends from conduit 144 to an electrically actuated injection valve 176, the outlet of which is connected to compressor 134 via conduit 178.

The driving motor of compressor 134 is preferably designed for variable speed operation and to this end it is connected to control means 180 which will preferably include a frequency inverter which in turn is connected to a suitable source of line power via leads 181. Thermostat 112 is also connected to control means 180 via conductors 128 and serves to deenergize the drive motor of compressor 134 in response to a sensed discharge gas temperature in excess of a predetermined maximum.

Thermostat 108 is also connected between the control means 180 and injection valve 176 and operates to control actuation of injection valve 176 in response to a sensed temperature of the discharge gas entering muffler chamber 86.

In operation, as the load on the refrigeration system increases, the temperature of the discharge gas entering muffler chamber 86 will also progressively increase. Once this temperature reaches a predetermined point, thermostat 108 will operate to connect injection valve 176 to a source of power to thereby energize valve 176 to an open position thereby enabling high pressure liquid refrigerant to flow from conduit 144 therethrough into the suction inlet of compressor 134 via conduits 174, 178 and fitting 130. At this point the liquid refrigerant will be mixed with the lower pressure suction gas, evaporate and serve to reduce the temperature of the suction gas entering the compression chambers. The lower temperature suction gas will then result in cooling of the compressor and a lowering of the discharge gas temperature. Once the discharge gas temperature has fallen below a predetermined temperature, thermostat 108 will operate to deenergize injection valve 176 thereby cutting off the flow of liquid being injected into the compressor.

If, for some reason, the injection of liquid into the suction opening is insufficient to prevent further increase in the discharge gas temperature, thermostat 112 will operate to deenergize compressor 134. Preferably thermostat 112 will be set to deenergize the compressor at a predetermined sensed temperature substantially above that temperature at which thermostat 108 operates to actuate injection valve 176 but yet below that at which any damage and/or degradation of the compressor and/or lubricant will occur. In this manner, the greatest possible assurance is provided that compressor 134 will provide continuous operation even under heavy load conditions yet protection will also be provided against potentially damaging overheating thereof. Further, this dual protection is provided at relatively low cost by the use of a single housing containing both thermostats.

Figure 5:
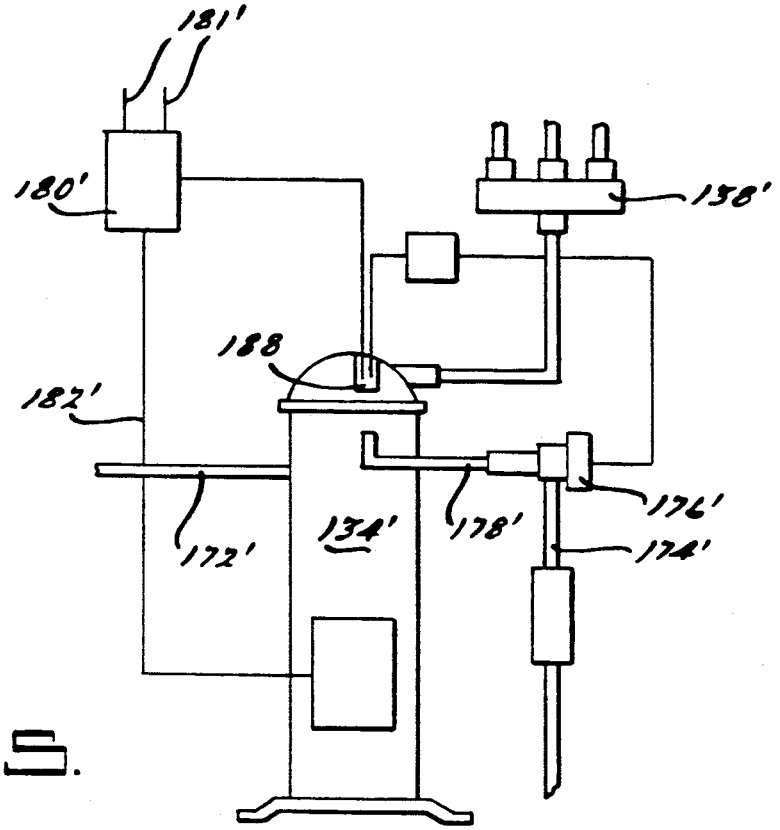
FIG. 5 is a schematic illustration of a portion of a refrigeration circuit similar to that of FIG. 4 but incorporating a modified version of the liquid injection system of the present invention.

While the above described system employs two thermostats within a single housing, the present invention may also be modified to utilize a single thermostat having two separate trip points. Such an arrangement is illustrated in FIG. 5 wherein components corresponding to those illustrated in FIG. 4 are indicated by the same reference numbers primed. As shown therein, a single thermostat 188 is provided which is connected to both control means 180' and valve 176'. Thermostat 188 will preferably be designed to actuate valve 176' to an open position upon sensing a first predetermined discharge temperature whereupon liquid refrigerant will be injected into the compressor to cool same. In the event the discharge temperature continues to increase to a second predetermined temperature, thermostat 188 will operate to interrupt power from source 181' thereby deenergizing the compressor. Preferably, thermostat 188 will be disposed within a well sealingly secured to shell 12 and extending into discharge chamber 86 similar to that described above.

Figure 6:
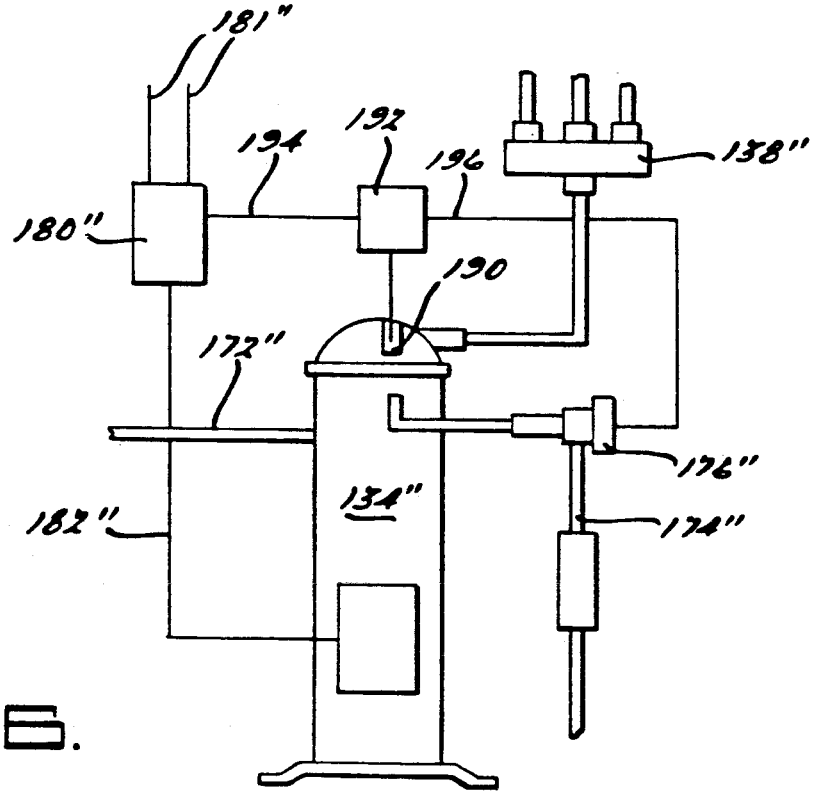
FIG. 6 is also a schematic illustration of a portion of a refrigeration circuit also similar to that of FIG. 4 but incorporating a further modification of the liquid injection system of the present invention.

Alternatively, in lieu of thermostat 188, a thermal sensor or transducer 190 may be provided disposed within a well in a similar manner as described above. As shown in FIG. 6, transducer 190 is connected to a suitable microprocessor 192 via conductor 194 and operates to provide a signal thereto indicative of the discharge temperature of the compressor. Microprocessor 192 is in turn connected to power supply 180" and valve 176" via conductors 194, 196, respectively, and operates in response to the temperature indicating signal received from transducer 190 to control energization of the compressor as well as actuation of valve 176" in the same manner as described above. More specifically, microprocessor will operate to actuate valve 176" to thereby inject liquid into the compressor once a first preprogrammed temperature is sensed by transducer 190. Should the discharge temperature continue to rise, microprocessor 192 will then operate to shut down the compressor.

As may now be appreciated, the liquid injection system of the present invention provides a highly accurate means to prevent possible overheating of the compressor. Because the thermally responsive sensor, be they a thermostat or thermal transducer, is located directly in the discharge gas flowpath, the system is much less subject to variances in ambient conditions and hence serves to provide liquid injection only when necessary. Because the injection of liquid will tend to reduce overall system efficiency, this increased accuracy not only provides improved compressor overheating protection but also minimizes the reduction in overall system efficiency by minimizing the amount of liquid actually injected into the compressor.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A liquid injection system for a refrigeration system comprising:

scroll type compressor means having first and second scroll members interleaved, said first scroll member being adapted to orbit relative to said second scroll member so as to define a plurality of fluid pockets which decrease in volume as they move toward the center of said scroll members, a suction inlet at the outer periphery of said first and second scroll members and a central discharge passage in one of said first and second scroll members, said central discharge passage opening into a discharge chamber;

an evaporator;

conduit means interconnecting said compressor means, condenser and evaporator in a closed loop series relationship;

sensor means disposed within said discharge chamber operative to sense the temperature of said compressed refrigerant;

injection conduit means connected to said conduit means between said evaporator and said condenser and having an outlet opening into said compressor means;

valve means within said injection conduit for controlling flow of refrigerant therethrough;

said sensor means being operative to control said valve means in response to said sensed temperature above a predetermined temperature.

2. A liquid injection system as set forth in claim 1 wherein said sensor means comprises a thermostat, said thermostat being operative to actuate said valve means in response to a predetermined discharge temperature.

3. A liquid injection system as set forth in claim 2 wherein said scroll type compressor is disposed within a hermetic shell, said discharge chamber being defined in part by a portion of said shell, said thermostat being disposed within a well formed in said portion of said shell.

4. A liquid injection system as set forth in claim 3 wherein said well projects into said discharge chamber.

5. A liquid injection system as set forth in claim 4 wherein said well is positioned in overlying relationship to said discharge passage whereby compressed refrigerant entering said discharge chamber may directly impinge on said well.

6. A liquid injection system as set forth in claim 1 wherein said injection conduit outlet opening is positioned immediately adjacent said suction inlet.

7. A liquid injection system as set forth in claim 6 wherein said scroll type compressor is disposed within a hermetic shell, said discharge chamber being defined in part by a portion of said shell and said sensor means is disposed within a well provided in said portion.

8. A liquid injection system as set forth in claim 7 wherein said sensor means comprises a thermostat, said thermostat being operative to actuate said valve means in response to a discharge gas temperature in excess of a predetermined temperature whereby liquid may flow through said injection conduit to said suction inlet.

9. A liquid injection system as set forth in claim 1 wherein said compressor is disposed within a hermetic shell, said discharge chamber being defined in part by a portion of said shell, said sensor means being disposed within a well provided in said portion and further comprising a second thermostat disposed within said well, said second thermostat being operative to deenergize said compressor in response to a discharge gas temperature above a second predetermined temperature.

10. A liquid injection system as set forth in claim 7 wherein said sensor means is further operative to deenergize said compressor in response to a discharge gas temperature above a second predetermined temperature.

11. A liquid injection system as set forth in claim 10 wherein said sensor means comprises a single thermostat operable in response to a discharge gas temperature above said first predetermined temperature to actuate said valve means and in response to a discharge gas temperature above said second predetermined temperature to deenergize said compressor.

12. A liquid injection system as set forth in claim 10 further including control means and said sensor means includes a thermal transducer operative to provide a signal to said control means indicative of the temperature of said discharge gas.

13. A liquid injection system as set forth in claim 12 wherein said control means comprises a microprocessor.

14. A refrigeration system incorporating a liquid injection system comprising:

an outer shell including means defining a discharge chamber therein;

a scroll type compressor disposed within said shell, said scroll compressor including a first scroll member having a first spiral wrap thereon, a second scroll member having a second spiral wrap thereon interleaved with said first wrap, a suction inlet opening at the outer periphery of said scroll members and a central discharge opening provided in one of said first and second wraps;

motor means within said shell including a drive shaft for orbitally driving one of said scroll members with respect to the other whereby said first and second wraps define moving fluid pockets for receiving refrigerant at said suction and discharging compressed refrigerant through said discharge opening into said discharge chamber;

a well formed in said outer shell and projecting into said discharge chamber;

a condenser;

an evaporator;

conduit means interconnecting said condenser and evaporator in series and said discharge chamber to an inlet of said condenser and an outlet of said evaporator in fluid communication with said suction inlet opening so as to form a closed loop system;

a fluid injection conduit having an inlet end connected to said conduit means between said condenser and evaporator and an outlet end opening into said suction inlet to thereby supply liquid refrigerant to said compressor;

valve means in said injection conduit for selectively controlling fluid flow therethrough; and temperature sensing means within said well for sensing the temperature of said compressed refrigerant entering said discharge chamber, said temperature sensing means being operative to actuate said valve means to enable liquid refrigerant to flow through said injection conduit to said suction inlet in response to a sensed temperature of said compressed refrigerant above a predetermined temperature.

15. A refrigeration system as set forth in claim 14 wherein said temperature sensing means comprises a thermostat disposed in said well, said thermostat being operable to control said valve.

16. A refrigeration system as set forth in claim 15 wherein said thermostat is also operative to deenergize said motor in response to a temperature above a second predetermined temperature.

17. A refrigeration system as set forth in claim 14 wherein said temperature sensing means comprises a thermal transducer operative to supply a signal to control means indicative of the temperature of said compressed refrigerant entering said discharge chamber to control means, said control means being operative to actuate said valve in response to a sensed temperature above said predetermined temperature.

18. A refrigeration system incorporating a liquid injection system comprising:

an outer shell including means defining a discharge chamber therein;

a scroll type compressor disposed within said shell, said scroll compressor including a first scroll member having a first spiral wrap thereon, a second scroll member having a second spiral wrap thereon interleaved with said first wrap, a suction inlet opening at the outer periphery of said scroll members, a central discharge opening provided in one of said first and second wraps, motor means within said shell including a drive shaft for orbitally driving one of said scroll members with respect to the other whereby said first and second wraps define moving fluid pockets for receiving refrigerant at said suction and discharging compressed refrigerant through said discharge opening into said discharge chamber;

a well formed in said outer shell and projecting into said discharge chamber;

a condenser;

an evaporator;

conduit means interconnecting said condenser and evaporator in series and said discharge chamber to an inlet of said condenser and an outlet of said evaporator in fluid communication with said suction inlet opening so as to form a closed loop system;

a fluid injection conduit having an inlet end connected to said conduit means between said condenser and evaporator and an outlet end opening into said suction inlet opening to thereby supply liquid refrigerant to said compressor;

valve means in said injection conduit for selectively controlling fluid flow therethrough; and a temperature sensor within said well for sensing the temperature of said compressed refrigerant entering said discharge chamber, said temperature sensing means being operative to actuate said valve means to enable liquid refrigerant to flow through said injection conduit to said suction inlet in response to a sensed temperature of said compressed refrigerant above a predetermined temperature and to deenergize said motor means in response to a sensed temperature a predetermined amount above said predetermined temperature.

19. A refrigeration system as set forth in claim 18 wherein said temperature sensing means comprises a thermostat disposed in said well, said thermostat being operable to control said valve.

20. A refrigeration system as set forth in claim 18 wherein said temperature sensing means comprises a thermal transducer operative to supply a signal to control means indicative of the temperature of said compressed refrigerant entering said discharge chamber, said control means being operative to actuate said valve in response to a sensed temperature above said predetermined temperature.

* * * * *

UNITED STATES PATENT AND TRADEMARK OFFICE

CERTIFICATE OF CORRECTION

PATENT NO. : 5,076,067

DATED : December 31, 1991

INVENTOR(S) : Werner H. Prenger and Stephen M. Seibel

It is certified that error appears in the above-identified patent and that said Letters Patent is hereby corrected as shown below:

ON THE TITLE PAGE:

Abstract, line 12, "tip" should be -- trip --.

Column 1, line 24, "discharg" should be -- discharge --.

Column 2, line 1, after "more" insert -- rapid --.

Column 3, line 67, "non-orbitin" should be -- non-orbiting --.

Column 6, line 57, before "conduit" insert -- a condenser --.

Column 8, lines 53-54, delete "to control means".

Signed and Sealed this

Twentieth Day of July, 1993

*Attest:*

Michael K. Kirk

MICHAEL K. KIRK

*Attesting Officer*

*Acting Commissioner of Patents and Trademarks*